United States Patent [19]

Kahrs et al.

[11] Patent Number: 4,818,196

[45] Date of Patent: Apr. 4, 1989

[54] VARIABLE CAPACITY VANE-TYPE MOTOR HAVING A CONTROL CHANNEL SELECTIVELY COMMUNICATING WITH THE WORK CHAMBER

[75] Inventors: Manfred Kahrs, Wiesbaden; Hermann Schoellhorn, Frankfurt am Main, both of Fed. Rep. of Germany

[73] Assignee: Alfred Teves GmbH, Frankfurt am Main, Fed. Rep. of Germany

[21] Appl. No.: 1,398

[22] Filed: Jan. 8, 1987

[30] Foreign Application Priority Data

Jan. 16, 1986 [DE] Fed. Rep. of Germany ..... 3601050

[51] Int. Cl.[4] ..... F01C 21/16; F03C 2/22

[52] U.S. Cl. ..... 418/22; 418/189

[58] Field of Search ..... 418/16, 22, 24–27, 418/210, 215, 15, 183, 189; 417/218, 220

[56] References Cited

U.S. PATENT DOCUMENTS

| | | | |
|---|---|---|---|
| 2,033,218 | 3/1936 | Yirava | 418/22 |
| 2,570,411 | 10/1951 | Vickers | 418/16 |
| 2,790,391 | 4/1957 | Holl | 418/22 |
| 3,455,245 | 7/1969 | Reichling | 418/133 |
| 3,612,733 | 10/1971 | Wilcox | 418/189 |
| 3,687,579 | 8/1972 | Martin | 418/26 |
| 4,406,599 | 9/1983 | Stephan | 418/22 |
| 4,659,297 | 4/1987 | Kahrs | 418/22 |

FOREIGN PATENT DOCUMENTS 2822102 11/1979 Fed. Rep. of Germany .

*Primary Examiner*—John J. Vrablik

*Attorney, Agent, or Firm*—James B. Raden

[57] ABSTRACT

A vane-type motor is disclosed including a rotor disposed in a housing having a plurality of cam rings surrounding the rotor, which cam rings are displaceable relative to one another in the circumferential direction. Vanes associated with the cam rings subdivide a work chamber provided between the rotor and the cam rings into work cells and side plates laterally confine the work chamber. An inlet channel supplies pressure fluid to the work chamber and a discharge channel provides for discharge of the pressure fluid from the work chamber. Control channels are provided to preclude pressure impacts and noises with the cam ring displaced. The control channels terminate in the work chamber and connect the work chamber to the inlet channel. The rotor forms a control element for the control channels.

4 Claims, 3 Drawing Sheets

VARIABLE CAPACITY VANE-TYPE MOTOR HAVING A CONTROL CHANNEL SELECTIVELY COMMUNICATING WITH THE WORK CHAMBER

BACKGROUND OF THE INVENTION

The present invention relates to a vane-type motor or pump including a rotor disposed in a housing, a plurality of cam ring members surrounding the rotor in axially disposed side-by-side relationship including sets of vanes respectively associated with a cam ring and displaceable in radially extending slots in the rotor and subdividing a working chamber disposed between the rotor and cam rings. Inlet and outlet orifices lead into working cells and cheek plates laterally confine the working chamber.

A vane-type motor of this type is disclosed in U.S. Pat. No. 3,455,245. This conventional vane-type motor includes two vane-type units disposed in a housing in axial side-by-side relationship which respectively include a cam ring, vanes and rotor element located between two cheek plates. The cam rings have identical stroke curves over which the vanes move and with respect to their stroke curves are in axial alignment. The two cam rings are disposed non-rotatably relative to one another and relative to the two cheek plates. In such a vane-type motor, the volumetric displacement of the motor or pump can be changed only in steps by changing the number of axially aligned units.

The periodical "Oelhydraulik Und Pneumatik" 19 (1975), No. 3, at pp. 153 et seq. describes an infinitely variable double-acting vane-type pump having only one cam ring rotatable relative to the inlet and outlet orifices for changing the volumetric displacement. An arrangement of this type produces adverse flow conditions likely to result in excessive pressure pulsations which require costly efforts for compensating the resultant disadvantageous effects.

U.S. patent application Ser. No. 805,345 now U.S. Pat. No. 4,659,294 discloses a vane-type motor including structures directed to overcoming the shortcoming heretofore experienced. That device includes at least one stroke ring that is rotatable in the circumferential direction relative to another stroke ring. A particularly simple form of this sort of vane-type motor provides for two stroke rings one of which is non-rotational. This device has the advantage that the displacement temporarily occurring due to rotation of one cam ring in a direction opposite to the normal direction of flow is substantially compensated by the stationary cam ring. Pressure pulsations and resultant torque fluctuatios and noises in this pump are relatively well controlled.

Although this type pump is an improvement, undesirable pressure fluctuations and noise problems still occur in the inlet channel and in the return line In particular, pronounced back-pressure pulsations are generated when rotation of the above cam ring creates a closed portion of the working chamber in which pressure fluid is trapped and compressed.

SUMMARY OF THE INVENTION

It is, therefore, the object of the present invention to provide for a vane-type motor which minimizes pressure fluctuations and noises.

According to the invention there is provided an infinitely variable vane-type motor in which the running noise and the pressure pulsation in the inlet channel of the motor are substantially reduced. Control channels are provided which serve to eliminate the extreme work chamber over-pressures formerly caused by the trapping and compression of pressure fluid.

According to an advantageous feature of the invention, control pockets are provided on the rotor for regulating the control channels.

The control channels preferably are formed, in part, by control bores provided in one of the side plates and, in part, by elongated holes or grooves provided in the rotatable cam ring which, upon rotation of the cam ring, can be brought into registry with the bores provided in one of the side plates and the stationary cam ring and in communication with the inlet channel.

BRIEF DESCRIPTION OF THE DRAWING

The invention will be better understood after a reading of the following Detailed Description Of The Preferred Embodiment in conjunction with the drawing in which.

DETAILED DESCRIPTION OF THE PREFERRED EMBODIMENT

Figure 1:
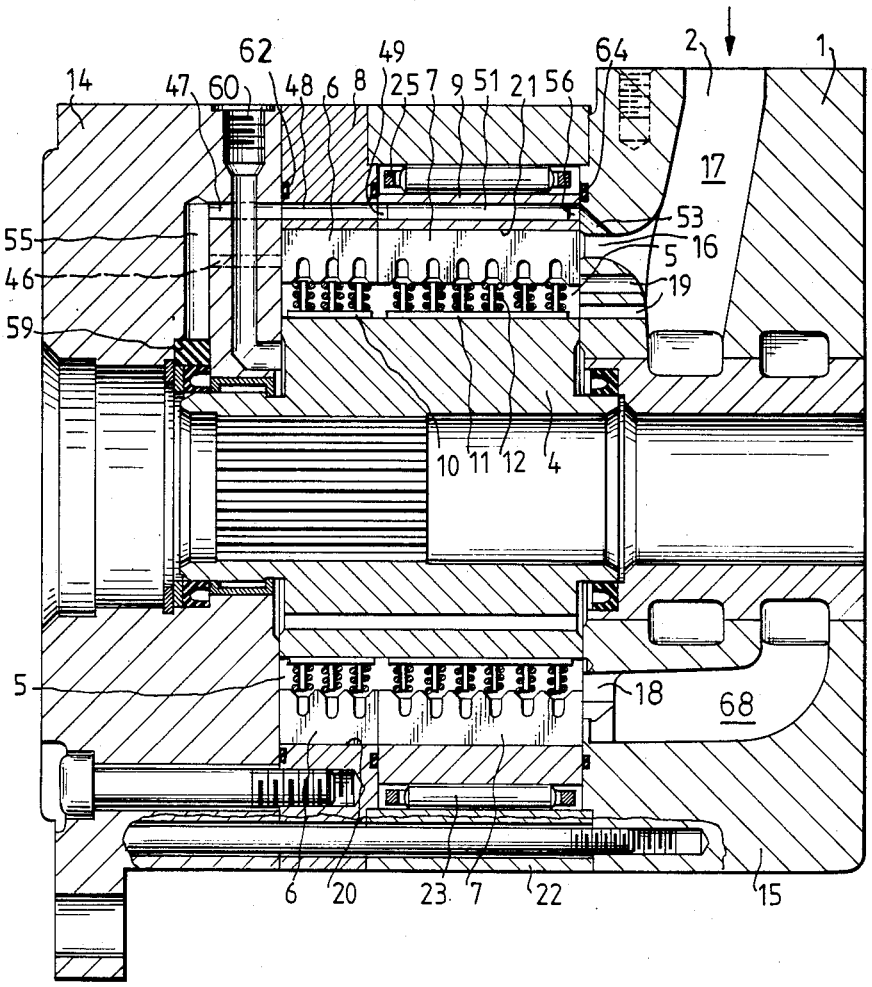
FIG. 1 is a longitudinal cross-sectional view through a vane-type motor, showing details of instruction.

The vane-type motor according to the invention includes a housing 1 made up of a variety of components, including a connection 2 serving to supply pressure fluid via a supply channel 17, and a connection (not shown) for discharging the pressure fluid via a discharge channel 68. Provided in the interior of the vane-type machine is a rotor 4 non-rotationally connected to a shaft for transmitting torque. The rotor is provided with radially extending slots 5 in which are disposed in radially displaceable manner respectively two vanes 6, 7. Vanes 6 can be placed into abutment with cam ring 8 while vanes 7 can be placed into abutment with cam ring 9. The abutment of vanes 6, 7 is supported by vane extending springs 12 guided by spring guide ledges 10, 11 disposed in bottom bores of slots 5.

Formed between cam rings 8, 9 and the cylindrical surface of the rotor is a working chamber subdivided by vanes 6,7 into working cells 13. The working cells 13 are axially confined by housing components in the form of side plates 14, 15.

The side plate 14 is provided with a port 60 for returning the leak oil discharged through the running gap between rotor 4 and side plates 14, 15. The side plate 15 includes a channel 17 leading from connection 2 to inlet openings 16, and a channel 68 leading from the outlet openings 18 to the connection for discharging the pressure fluid. The inlet and outlet openings 16, 18 are of generally kidney-shaped configuration formed in the surface of the side plate 15 facing the working chamber. The number of the inlet openings 16 and outlet openings 18 corresponds to the number of the cam curves 20, 21 respectively formed on the cam rings 8, 9. Moreover, channels 19 for the pressure fluid supply to the bottom bores of slots 5 are formed in the side plate 15 for supporting abutment of the vanes in predetermined phases.

Seals 62,64 on the axial faces of the cam rings 8, 9 are disposed between the side plates 14 and 15. Cam ring 8 is rigidly connected to side plate 14. Provided between cam ring 8 and side plate 15 is an intermediate ring 22 surrounding the cam ring 9. The side plate 14, cam ring 8, intermediate ring 22 and side plate 15 are rigidly interconnected to form the housing 1 of the vane-type motor.

Cam ring 9 is disposed between cam ring 8 and the side plate 15 with a running clearance and is radially supported on the intermediate ring 22 by an anti-friction bearing 23 or alternatively by a slide bearing (not shown) so that it is rotatable in the circumferential direction.

The bearing of the cam ring 9 in the intermediate ring 22 is not effected along the entire circumference but rather, for example, at five supporting points 24 circumferentially distributed. The anti-friction elements are held by a cage 25 or other means at the predetermined space.

Figure 2:
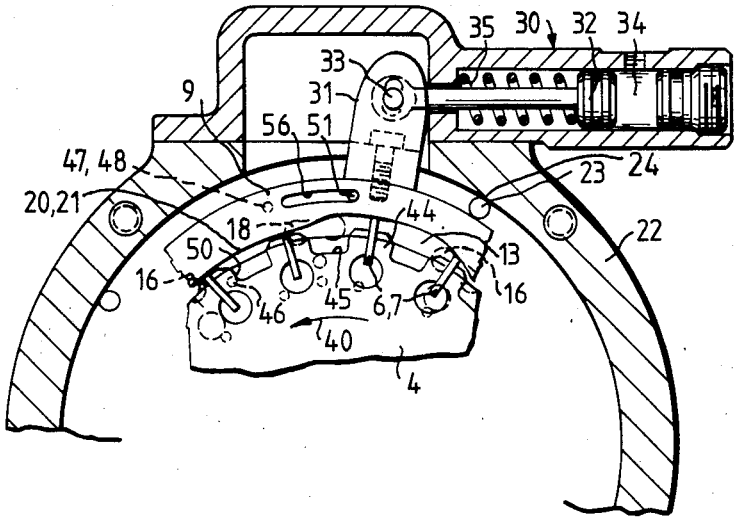
FIG. 2 is a cross-sectional view of the vane-type motor according to FIG. 1 taken in the plane of the rotatable cam ring showing further details of the construction.

As shown in FIG. 2, a rotating unit 30 is disposed substantially tangentially to the cam ring 9 and, a fork-shaped intermediate element 31 extends through an opening in the cage 25 and is in engagement with the cam ring 9. The legs of the intermediate element 31 are provided with elongated holes in which is slidingly guided a bolt 33 connected to a displacing piston 32. The displacing piston 32 is located in a pressure fluid chamber 34 and is displaceable by a control pressure. Because the motor according to this embodiment rotates in one direction only, the displacing piston includes only one pressure face for displacement against the reaction moment. Disposed between displacing piston 32 and housing 1 is a reset spring 35 for applying pressure to the cam ring 9 in a direction opposite the direction of rotation of rotor 4, which holds the rotor at the housing stop which, according to FIG. 2, is the right-hand stop, when the motor rotating unit is non-pressurized.

Formed between the portions 44 of the rotor 4 receiving the vanes 7 are respective control pockets 45 which communicate directly with working chambers 13, 13'. Provided in the adjacent side plate 14 are control bores 46 correspondingly extending in axially parallel direction which, as viewed in the radial direction, are disposed at the level of the control pockets 45 and which are part of control channels connecting the working chamber 13, 13' to the inlet channel 16 as rotor 4 rotates. The control channels, one of which is provided for each working chamber, are cyclically opened and closed by control pockets 45 moving into and out of registry with the control bores 46. As another part of the control channel, bores 47 are provided in the side plate 14 extending in parallel to the control bores 46, which are in communication with the control bores by way of channels 55 (only one of which are shown) and which preferably can also be formed as an annular channel. The channels 55 on the radially inward side are sealed by sealing elements 59. Corresponding ports 48 disposed on the same radius are provided in cam ring 8. Each of these ports 48 lead to an elongated hole or groove 49 formed in the cam ring 8. Groove 49, by way of a port 51 provided in cam ring 9, is in communication with an elongated hole or groove 56 formed on the other side of the cam ring 9. Groove 56, in turn, by way of a port 53, is in communication with the inlet channel 17.

Figure 3:
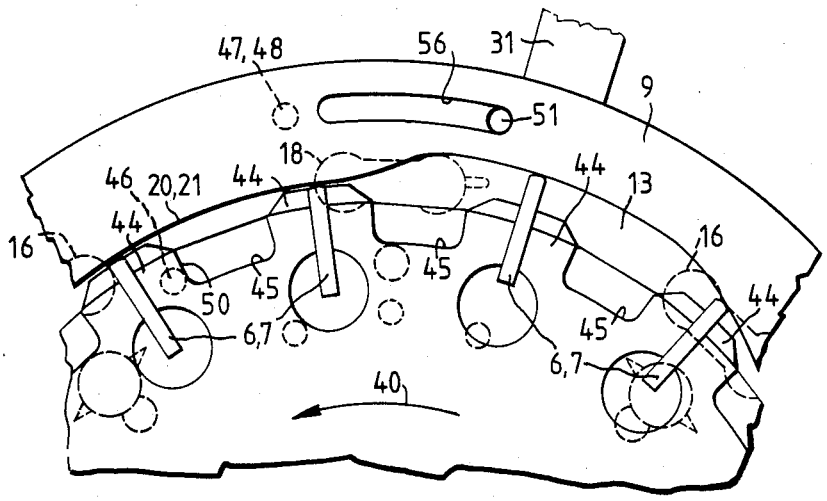
FIG. 3 and FIG. 4 are schematically illustrated cam curves of the pump of FIGS. 1 and 2.
Figure 4:
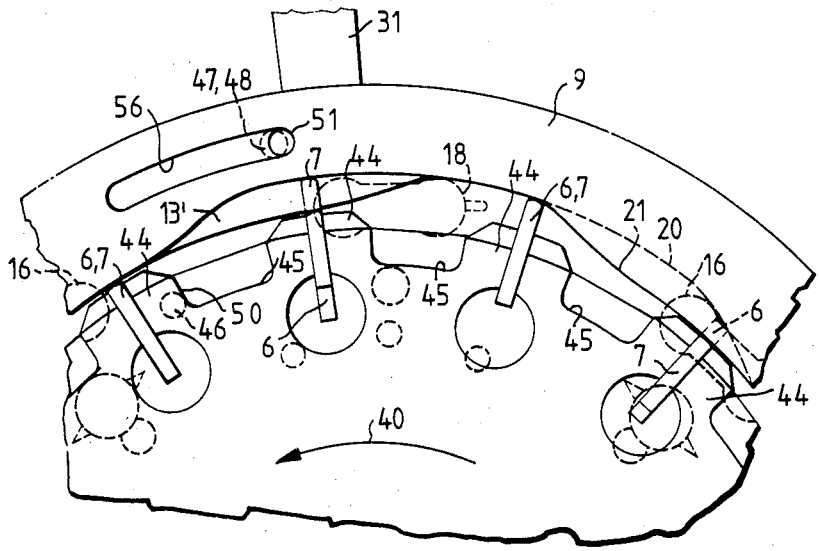

Operation of the vane-type motor according to the invention, will be explained in the following with reference to FIGS. 3 and 4:

FIGS. 3 and 4 shows vane extending conditions in the course of the rotation of the rotor 4. Vanes 6 and 7 which, in the illustration are arranged in series take different positions during rotation of the rotor in the direction as shown by arrow 40. FIG. 3 shows the position of the cam curve 20 of the stationary cam ring 8 and the position of the cam curve 21 of the cam ring 9 relative to an inlet opening 16 and outlet opening 18 in the non-rotated state of the ring 9. FIG. 4 shows the position of the cam curve 21 with the cam ring 9 rotated relative to the stationary cam ring 8.

Reference is first made to the case as illustrated in FIG. 3 wherein the cam curves 20, 21 of both cam rings 8, 9 are in axial alignment. In the embodiment shown, the cam curves 20, 21 of both cam rings 8, 9 are of identical configuration. According to the illustration in FIG. 3, the cam curves 20, 21 of both cam rings 8, 9 are in the normal position. High-pressurized pressure fluid, is passed by inlet opening 16 into the working cell 13 causing a rotation of the rotor 4 in the direction identified by arrow 40. The fluid is then passed through the outlet opening 18 to the connection for discharging the relieved pressure fluid. Vanes 6, 7 synchronously change position against the force of springs 12 when passing through the various positions in the slot 5 of the rotor 4. Bores 47 and 48 are not in registry with bore 51 so that there is no connection, to the inlet channel. The motor thereby operates on maximum work volume, that is, with minimum speed and maximum torque.

Reference is now made to the case in which the cam curve 20 of the stationary cam ring 8, as shown in broken lines in FIG. 4, remains unchanged and the cam curve 21 takes the position identified by the solid line relative to the inlet and outlet opening 16, 18 respectively. Vanes 6, 7 no longer displace synchronously as the movement of vane 6 is determined by the cam curve 20, and the movement of vane 7 is determined by cam curve 21 which is displaced from curve 20. A reduction in work volume from the maximum work volume thereby occurs.

In the position according to FIG. 4, bores 48 and 51, at least in part, are in registry. Because control bore 46 is in a predetermined position relative to the cam curve 21, and because there is a corresponding dimensioning of control pockets 45, the control edge 50 of the control pockets releases the aperture of the control bore 46 when cell 13' reduces in size. Due to the rapid opening of the control bore 46, a connection to the inlet channel is established and a sudden pressure build-up in the cell 13' is precluded, thereby eliminating the pronounced pressure fluctuations which would otherwise result from a compression of fluid trapped in the contracting working cell 13'. The control will become efective especially upon a displacement of the cam ring between about 5° and a maximum displacement angle.

What is claimed is:

1. A vane-type motor comprising, a housing, a rotor disposed in said housing, at least two cam rings surrounding said rotor in axially disposed side-by-side relationship, at least one of said cam rings being rotatable in a circumferential direction relative to another of said cam rings, sets of vanes respectively associated with each of said cam rings, said vanes being displaceable in radially extending slots in said rotor and subdividing a work chamber between said rotor and said cam rings into work cells, two side plates laterally confining said work chamber, an inlet channel to supply a pressure fluid to the work chamber, a discharge channel through which said pressure fluid can be discharged from the work chamber and a control channel selectively communicating between said inlet channel and said work chamber, said rotor defining a control element means to cyclically cause communication via said control channel between said work chamber and said inlet channel to preclude and control sudden pressure build-up in said work chamber.

2. A vane-type motor according to claim 1, wherein said control element includes at least one control pocket on said rotor which moves alternately into and out of registry with said control channel.

3. A vane-type motor according to claim 1 wherein said control channel includes at least one control bore provided in one of said side plates.

4. A vane-type motor according to claim 1, wherein said control channel includes at least one elongated opening provided in a rotatable cam ring which upon rotation of said rotatable cam ring registers with a bore provided in one of said side plates and a stationary cam ring to interconnect, said bore with said inlet channel.

* * * * *